US005332416A

United States Patent [19]

Calos

[11] Patent Number: 5,332,416

[45] Date of Patent: Jul. 26, 1994

[54] METHOD FOR SEPARATING SLAG AND NONMETALLIC PARTICLES DURING MOLTEN METAL TEEMING OPERATIONS USING MELTABLE DAM

[75] Inventor: James D. Calos, Lockport, N.Y.

[73] Assignee: Allegheny Ludlum Corporation, Pittsburgh, Pa.

[21] Appl. No.: 872,464

[22] Filed: Apr. 23, 1992

[51] Int. Cl.[5] ..... C22B 9/00

[52] U.S. Cl. ..... 75/414; 75/582; 75/584; 164/337; 266/227

[58] Field of Search ..... 75/584, 582, 407, 414; 266/275, 227; 164/337

[56] References Cited

U.S. PATENT DOCUMENTS

| | | | |
|---|---|---|---|
| 631,736 | 8/1899 | Collins . | |
| 3,193,892 | 7/1965 | Sickbert | 22/85 |
| 4,043,543 | 8/1977 | Courtenay et al. | 266/275 |
| 4,125,146 | 11/1978 | Muller et al. | 164/337 |
| 4,522,322 | 6/1985 | Guntermann et al. | 222/587 |
| 4,549,600 | 10/1985 | Kauserud | 164/323 |

FOREIGN PATENT DOCUMENTS

| | | | |
|---|---|---|---|
| 213616 | 9/1988 | Japan | 266/227 |
| 34551 | 2/1989 | Japan | 75/584 |
| 8000546 | 4/1980 | PCT Int'l Appl. . | |

*Primary Examiner*—Melvyn J. Andrews
*Attorney, Agent, or Firm*—Patrick J. Viccaro

[57] ABSTRACT

A method and apparatus is provided for temporarily retaining slag and nonmetallic particles in a tundish while molten metal is being transferred through the tundish to other desired vessels. In particular, a meltable dam is placed into an opening between the chambers in a tundish, and the meltable dam retains an accumulation of molten metal in the pour chamber of the tundish with the slag and nonmetallic particles floating on top of that level such that the slag and nonmetallic particles are above the opening between the chambers of the tundish. The dam then completely melts and allows the transfer of molten metal through the opening. The slag and nonmetallic particles are retained in the pour chamber, however, because the molten metal being transferred into the pour chamber maintains the level in that chamber above the opening until almost all of the metal has been transferred into and through the chamber. In this manner, problems associated with the transfer of slag and nonmetallic particles with the first flow of molten metal in VIM teeming operations are eliminated.

10 Claims, 2 Drawing Sheets

METHOD FOR SEPARATING SLAG AND NONMETALLIC PARTICLES DURING MOLTEN METAL TEEMING OPERATIONS USING MELTABLE DAM

BACKGROUND OF THE INVENTION

1. Field of the Invention

The invention relates to a method and apparatus for separating slag and nonmetallic particles from molten metal during teeming operations. Specifically, the invention provides a meltable dam which retains the slag and nonmetallic particles in a tundish while molten metal is transferred through the tundish.

2. Description of the Invention Background

In processes for making steel and other alloys, metals are typically heated to a molten state and transferred from one vessel to another. In particular, the molten metal is often transferred from a ladle into a tundish, or multiple tundishes, and then transferred from the tundish into molds such as ingot molds. This operation of transferring the molten metal is called teeming.

In a typical teeming operation contaminant materials such as slag and nonmetallic particles are transferred along with the molten metal. The slag and nonmetallic particles may interfere with the teeming operation and are detrimental to the quality of the desired metal product which is formed in the ingot molds.

For example, in a vacuum induction melt (VIM) teeming operation the molten metal is top poured from a furnace into a tundish. The molten metal then flows from the tundish through flow channels which direct the molten metal to another vessel, such as molds or additional tundishes. Slag and nonmetallic particles usually occur in the molten metal and float on top of the molten metal because they are less dense than the molten metal. Typically, the slag and nonmetallic particles enter the tundish and subsequent flow channels with the first flow of the molten metal because the molten metal is top poured during VIM teeming operations.

The transfer of the slag and nonmetallic particles along with the molten metal creates several problems during the teeming operation. First, the slag and nonmetallic particles may block the various flow channels through which the molten metal must flow. In particular, slag and nonmetallic particles have been known to block the nozzles through which the molten metal leaves the tundish during VIM teeming operations. This may cause an excess amount of molten metal to remain in the tundish because the molten metal cannot properly flow from the tundish. In addition, the presence of the slag and nonmetallic particles in the first flow of the molten metal will tend to reduce the desired quality of cast metal because these nondesired materials are carried through to the molds.

Thus, a need exists for a method and apparatus to prevent slag and nonmetallic particles from being carried with the first flow of molten metal through a tundish into the molds during a teeming operation. More particularly, a need exists for retaining the slag and nonmetallic particles in a tundish during a VIM teeming operation until the molten metal flows through the tundish into the molds.

SUMMARY OF THE INVENTION

The present invention solves the problems associated with the transfer of slag and nonmetallic particles during conventional teeming operations. In particular, the present invention provides a method and apparatus for retaining the slag and nonmetallic particles in a tundish until the molten metal has been transferred through the tundish into desired molds. The present invention provides for an initial accumulation of molten metal in the tundish which causes the slag and nonmetallic particles to rise above the top of the flow channel in the tundish thereby allowing the molten metal to drain from the tundish while retaining the slag and nonmetallic particles in the tundish.

Accordingly, the present invention provides a method and apparatus for separating slag and nonmetallic particles during the transfer of molten metal in which the flow of the molten metal is temporarily prevented by a meltable dam until the molten metal level rises above the discharge flow channel for the molten metal. In particular, the molten metal is transferred into a first chamber of a vessel. The molten metal is then transferred from the first chamber to a second chamber of the vessel through an opening which interconnects to the two chambers. Finally, the molten metal is discharged and from the second chamber into flow channels which direct the molten metal to desired molds. In the present invention a meltable dam is placed in the opening between the first and second chambers of the vessel to temporarily prevent the flow of the molten metal through that opening until the molten metal level rises above the top of the opening. The dam then melts and allows the molten metal to flow through the opening. Nevertheless, because molten metal is continually being transferred into the first chamber, the molten metal level remains above the top of the opening until all of the molten metal has been transferred into the first chamber. Once the flow of molten metal into the first chamber is stopped the molten metal level drops below the top of the opening and the slag and nonmetallic particles flow through the vessel into the flow channels with the last flow of the molten metal.

The meltable dam is shaped to fit into the opening in the vessel so that no molten metal can flow through the opening until the dam melts. In a preferred embodiment, the meltable dam is folded along a center axis to form a v-shaped trough or channel which will fit snugly into the opening. The v-shaped meltable dam forms an angle ranging from about 10° to 55°. Further, the meltable dam has a composition which is compatible with the molten metal, and in a preferred embodiment, the meltable dam is made from 4 to 6 layers of a nickel foil which has a thickness of about 0.002 inches. Most preferably, the meltable dam takes about 3 to 5 seconds to melt after contact with the molten metal.

DETAILED DESCRIPTION OF THE INVENTION

Figure 1A:
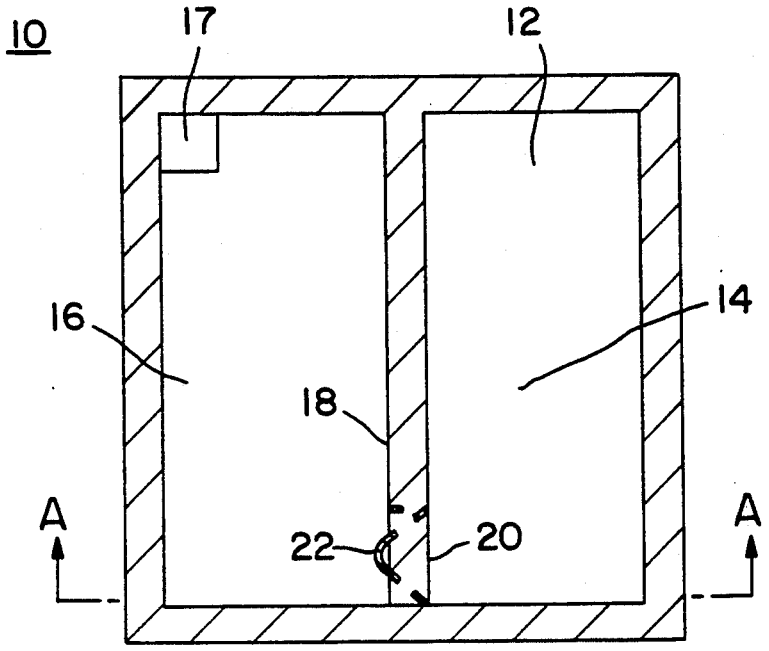
FIG. 1*a* is a top cut-away view of a conventional tundish in which the apparatus of the present invention has been installed.
Figure 1B:
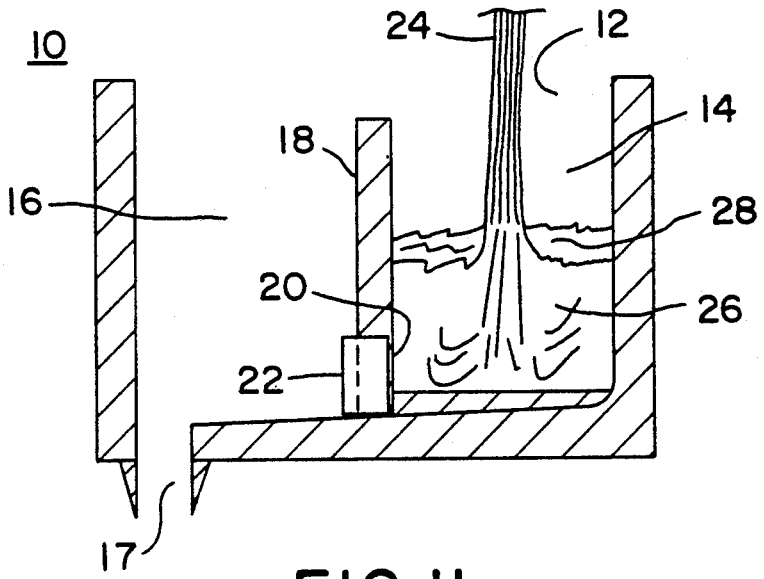
FIG. 1*b* is a cross-sectional view along section line A—A from FIG. 1*a* of a conventional tundish in which the apparatus of the present invention has been installed and showing molten metal being poured into the tundish.

Referring to the drawings, and more particularly to FIG. i a conventional vacuum induction melt (VIM) tundish 10 is depicted. Tundish 10 is maintained within a vacuum chamber (not shown). The tundish 10 includes a substantially open top portion 12 through which the molten metal enters the tundish 10. Further, the tundish 10 consists of a pour chamber 14 and a delivery chamber 16 which are separated by a weir 18 with an opening 20 at the bottom of the weir 18.

Molten metal enters the pour chamber 14 of the tundish 10 through the opening 12. The molten metal then flows from the pour chamber 14 through the weir opening 20 into the delivery chamber 16. The molten metal is discharged from the delivery chamber 16 through a nozzle 17 into a channel (not shown) which directs the molten metal to molds.

Referring now to FIGS. *2a*, *2b*, and *2c* the formation of the meltable dam 22 of the present invention is shown. In particular, a flat piece of metal foil 30 is folded upon itself four times like an accordion to make a five layer piece 32. If a six layer piece is desired then five folds are made in the piece of the metal foil, and if a four layer piece is desired then three folds are made in the piece of metal foil. The piece 32 is then cut, if necessary, to a size so that once the piece 32 is shaped it will match the dimensions of the weir opening 20. For example, the piece 32 is cut into a rectangular piece which has the same height as the weir opening 20 but is wider than the weir opening 20.

Figure 2A:
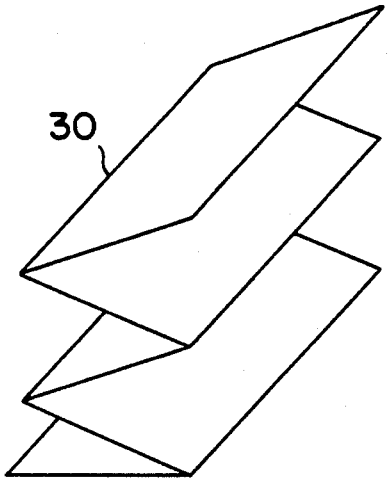
FIGS. 2*a*, 2*b*, and 2*c* are a series of perspective views showing the formation of the apparatus of the present invention.
Figure 2B:
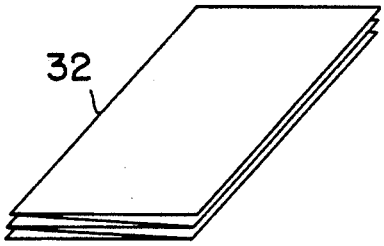
Figure 2C:
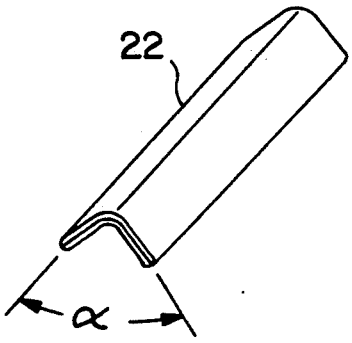

The piece 32 is then bent or folded along a line at or near the center axis of the piece 32 in the form of a v-shaped trough or channel. The length of the fold line corresponds to the height of the weir opening 20. The resulting v-shaped piece 22 forms an acute angle (designated as $\alpha$ in FIG. 2C) ranging from about 10° to 55° as measured between the opposing sides of the v-shape trough with the fold line as the vertex of the angle. The v-shaped piece 22 forms the completed meltable dam.

The width between the opposing sides of the v-shaped trough of the meltable dam 22 is slightly larger at its widest part than the width of the weir opening 20. When these sides are slightly compressed the meltable dam 22 may be inserted into the weir opening 20 so that the meltable dam 22 will fit snugly into the weir opening 20. In this manner, the meltable dam 22 is held in the weir opening 20 by the pressure exerted by the natural outward bias of the opposing edges of the sides forming the v-shape. The force exerted is sufficient to withstand the hydrostatic pressure from the molten metal when it is poured into the pour chamber 14. The width of the piece 32 before it is shaped into the meltable dam 22 is easily determined by one of ordinary skill in the art using trial and error based on the criteria that the meltable dam 22 will have a slightly larger width than the weir opening 20. Further, the width of the meltable dam 22 can be adjusted to some degree by simply folding the meltable dam 22 to decrease or increase the angle of the v-shape. If the piece 32 is not as tall as the weir opening 20 a longer piece 32 can be constructed. Alternately, the height of the weir opening 20 may be reduced by placing weir brick in the weir opening 20 to shorten it.

The composition and thickness of the metal foil is critical to the method and apparatus of the present invention for the following four reasons: (1) the metal foil composition should withstand melting until the molten metal level has risen above the weir opening so that the slag and nonmetallic particles are retained in the tundish pour chamber; (2) the metal foil composition should provide sufficient strength to withstand the hydrostatic pressure exerted by the molten metal in the pour chamber; (3) the metal foil composition must be compatible with the molten metal so that it readily mixes with the molten metal without contaminating the molten metal; and (4) the composition and thickness should allow the metal foil to melt completely so that no particles or pieces of the metal foil block the tundish discharge nozzle or downstream flow channels.

Preferably, for Ni-base alloys the metal foil composition is primarily nickel. Nickel foil has proven to withstand the molten metal without melting for an appropriate amount of time and to withstand hydrostatic pressure exerted by the molten metal. In addition, the nickel foil is compatible with many molten metals, does not decrease the quality of metal cast from the molten metal, and melts completely without forming pieces that can block the tundish delivery nozzle. The term "compatible" in reference to the metal foil composition and the molten metal indicates that the metal foil, once melted and mixed with the molten metal, will not adversely alter the properties of the molten metal during the teeming operation nor will it adversely alter the properties and characteristics of the metal product which is cast from the molten metal.

Most preferably, for Ni-base alloys the metal foil used is a cold rolled, annealed nickel, type 201, with a thickness of 0.005 inches, which has a nominal composition as follows:

| element | wt. % |
|---|---|
| nickel | 99.65 |
| carbon | 0.019 |
| manganese | 0.10 |
| sulfur | 0.002 |
| silicon | 0.03 |
| copper | 0.02 |
| iron | 0.09 |
| tin | 0.001 |

The ability of the folded metal foil piece to withstand melting is dependent on both its composition and thickness. If the metal foil composition melts too readily the molten metal level will not have a chance to rise above the weir opening. On the other hand, if the metal foil composition is too resistant to melting it will melt too slowly and cause the pour chamber to overflow or delay the rate at which molten metal is transferred into the pour chamber. In addition, the thickness of the folded metal foil piece will affect the ability of the piece to withstand melting and the hydrostatic pressure from the molten metal. It should be appreciated that the thickness of the folded metal foil piece is dependent on both the number of layers of metal foil and the thickness of each layer. Preferably, we have found that 4 to 6 layers of nickel foil with a thickness of 0.005 inches (a total thickness of 0.020 to 0.030 inches) provides a melt-out time of 3 to 5 seconds.

Referring to FIG. *1b*, the operation of the present invention will be explained. A meltable dam 22 according to the present invention is shaped and installed in the weir opening 20 of the tundish 10. A molten metal stream 24 is top poured into the pour chamber 14 of the tundish 10 through the opening 12. The meltable dam 22 blocks the weir opening 20 so that molten metal 26 accumulates in the pour chamber 14 of the tundish 10. Slag and nonmetallic particles in the accumulated molten metal 26 float to the top of the molten metal in the pour chamber 14 to form a slag and nonmetallic particles layer 28. The slag and nonmetallic particle layer 28 rises above the top of the weir opening 20 along with the accumulated molten metal 26.

After the accumulated molten metal 26 rises above weir opening 20 the meltable dam 22 melts away, and molten metal from the bottom of accumulated molten metal 26 in the pour chamber 14 flows through weir opening 20 into the delivery chamber 16 while the slag and nonmetallic particle layer is maintained on top of the accumulated molten metal 26. Once all of the molten metal has been transferred into the pour chamber 14, the level of the accumulated molten metal 26 will drop below weir opening 20, and the last of the molten metal along with the slag and nonmetallic particle layer 28 will flow through weir opening 20 into delivery chamber 16. The last molten metal flow along with the slag and nonmetallic particle layer then flows from the delivery chamber 16 through nozzle 17 into a channel that directs the molten metal into the desired molds.

EXAMPLE

Pieces of nickel foil (NI201) with a thickness of approximately 0.005 inches which was nine inches square were folded accordion style to create pieces of four layers and six layers. The pieces had overall thicknesses of 0.025 and 0.030 inches and were about two inches by nine inches. The pieces were folded in a v-shape along a center axis of the nine inch dimension. The resulting v-shaped pieces formed angles of between 10° to 55° with a distance between the two folded edges of about 0.750 inches and a height of about 1 inch. The pieces were then placed in a weir opening in a primary tundish which had dimensions of nine inches by 0.75 inches.

Two tests with the four layer pieces showed that they would block the weir opening with little or no initial penetration and held the molten metal in the pour chamber of the tundish until the molten metal level was above the weir opening. The piece melted-out in about 3 to 4 seconds. A test with a six layer piece also showed no initial penetration and held the molten metal in the pour chamber of the tundish until the molten metal level reached within 1.5 inches of the top of the weir. The piece then melted-out.

A test with only two layers of the same metal foil allowed penetration in 1 to 2 seconds which was not sufficient to retain the slag. Likewise, tests with a nickel foil (NI270) with a thickness of 0.002 inches in pieces of two and four layers had melt outs in less than a second and 1 to 2 seconds, respectively. These pieces were also not acceptable for retaining the slag.

It should be appreciated that the method and apparatus of the present invention and its corresponding advantages for separating slag and nonmetallic particles during teeming operations will be understood from the detailed description and examples provided above. Nonetheless, the detailed description and examples provided above are merely illustrative of the claimed method and apparatus, and variations and changes could be made in the method and to the form, construction, and arrangement of the meltable dam without departing from the spirit and scope of the invention as claimed. For example, the meltable dam could have a composition which is the same as the molten metal which is being transferred during the teeming operation.

What is claimed is:

1. A method for transferring molten metal without any slag and nonmetallic particles, the method comprising the steps of:

a) transferring molten metal into a first chamber of a vessel, said first chamber being interconnected with a second chamber of said vessel by an opening;

b) temporarily preventing the flow of the molten metal through said opening with a sealing means until said molten metal forms a level in said first chamber which rises above a top of said opening; said sealing means comprising a meltable dam made of one or more layers of metal foil having sufficient strength to withstand the hydrostatic pressure of the molten metal;

c) transferring the molten metal from said first chamber to said second chamber through said opening;

d) transferring the molten metal from said second chamber to a desired other vessel;

whereby slag and nonmetallic particles floating on the molten metal in said first chamber will be retained in said first chamber until the last flow of the molten metal through said opening.

2. The method recited in claim 1 wherein said meltable dam has a composition which is compatible with the molten metal.

3. The method recited in claim 2 wherein said meltable dam melts in about 3 to 5 seconds.

4. In a method for transferring molten metal, the method comprising the steps of (1) transferring molten metal into a first chamber of a vessel, (2) transferring the molten metal from said first chamber to a second chamber in the vessel through an opening which interconnects said first chamber and said second chamber, and (3) transferring the molten metal from said second chamber to a desired other vessel, the improvement comprising the step of preventing the flow of the molten metal through said opening with a meltable dam until said molten metal level rises above said opening, wherein said meltable dam is folded along a line generally on the center axis to form a v-shaped trough.

5. The improved method recited in claim 4 wherein slag and nonmetallic particles floating on the molten metal will be retained in said first chamber until the molten metal has been transferred into said first chamber and flows through said opening.

6. The improved method recited in claims 4 wherein said meltable dam is shaped to fit into said opening.

7. The improved method recited in claim 4 wherein said v-shaped trough forms an angle ranging from about 10° to 55°.

8. The improved method recited in claims 4 wherein said meltable dam has a composition which is compatible with the molten metal.

9. The improved method recited in claims 4 wherein said meltable dam comprises four to six layers of a nickel foil, said nickel foil having a thickness of about 0.005 inches.

10. The improved method recited in claim 4 wherein said meltable dam substantially melts in about 3 to 5 seconds after contact with the molten metal.

* * * * *